US009192037B2

(12) United States Patent
Ueno

(10) Patent No.: US 9,192,037 B2
(45) Date of Patent: Nov. 17, 2015

(54) CONTROL METHOD FOR TARGET SUPPLY DEVICE, AND TARGET SUPPLY DEVICE

(71) Applicant: GIGAPHOTON INC., Oyama-shi, Tochigi (JP)

(72) Inventor: Yoshifumi Ueno, Oyama (JP)

(73) Assignee: Gigaphoton Inc., Tochigi (JP)

( * ) Notice: Subject to any disclaimer, the term of this patent is extended or adjusted under 35 U.S.C. 154(b) by 170 days.

(21) Appl. No.: 13/960,108

(22) Filed: Aug. 6, 2013

(65) Prior Publication Data

US 2014/0042653 A1 Feb. 13, 2014

(30) Foreign Application Priority Data

Aug. 9, 2012 (JP) ..... 2012-177485

(51) Int. Cl.
*H05G 2/00* (2006.01)

(52) U.S. Cl.
CPC ..... *H05G 2/003* (2013.01); *H05G 2/006* (2013.01); *H05G 2/005* (2013.01); *H05G 2/008* (2013.01)

(58) Field of Classification Search
None
See application file for complete search history.

(56) References Cited

U.S. PATENT DOCUMENTS 7,405,416 B2 7/2008 Algots et al.
2010/0213272 A1 * 8/2010 Yabu et al. ..... 239/102.1

* cited by examiner

*Primary Examiner* — Mary F Theisen
(74) *Attorney, Agent, or Firm* — Studebaker & Brackett PC

(57) ABSTRACT

A control method for a target supply device includes melting a target material by heating the target material within a target generator using a heating unit, pushing out the target material from a nozzle hole in a nozzle by pressurizing the interior of the target generator using a pressure control unit, determining whether or not the size of an adhering area of the target material that forms when the target material is pushed out from the nozzle hole and adheres to a leading end of the nozzle has reached a set size that covers the entire nozzle hole, stopping the pressurization of the interior of the target generator by the pressure control unit when the size of the adhering area has reached the set size, and hardening the target material in the target generator and the adhering area by stopping the heating of the target material by the heating unit.

6 Claims, 11 Drawing Sheets

CONTROL METHOD FOR TARGET SUPPLY DEVICE, AND TARGET SUPPLY DEVICE

CROSS-REFERENCE TO RELATED APPLICATION

The present application claims priority from Japanese Patent Application No. 2012-177485 filed Aug. 9, 2012.

BACKGROUND

1. Technical Field

The present disclosure relates to control methods for target supply devices and to target supply devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A control method for a target supply device according to an aspect of the present disclosure is a control method for a target supply device that is provided in an EUV light generation apparatus and that includes a target generator having a nozzle and holding a target material, a pressure control unit configured to control a pressure within the target generator, and a heating unit configured to heat the target material within the target generator, and the method may include: melting the target material by heating the target material within the target generator using the heating unit; pushing out the target material in the target generator from a nozzle hole in the nozzle by pressurizing the interior of the target generator using the pressure control unit; determining whether or not the size of an adhering area of the target material that forms when the target material is pushed out from the nozzle hole and adheres to a leading end of the nozzle has reached a set size that covers the entire nozzle hole; stopping the pressurization of the interior of the target generator by the pressure control unit when the size of the adhering area has reached the set size; and hardening the target material in the target generator and the adhering area by stopping the heating of the target material by the heating unit.

A target supply device according to an aspect of the present disclosure may include a target generator and an adhering area. The target generator may have a nozzle and may be configured to hold a target material. The adhering area may be composed of the same material as the target material and may adhere to a leading end of the nozzle at a set size that covers the entirety of a nozzle hole of the nozzle.

BRIEF DESCRIPTION OF THE DRAWINGS

Hereinafter, selected embodiments of the present disclosure will be described with reference to the accompanying drawings.

DETAILED DESCRIPTION

Figure 1:
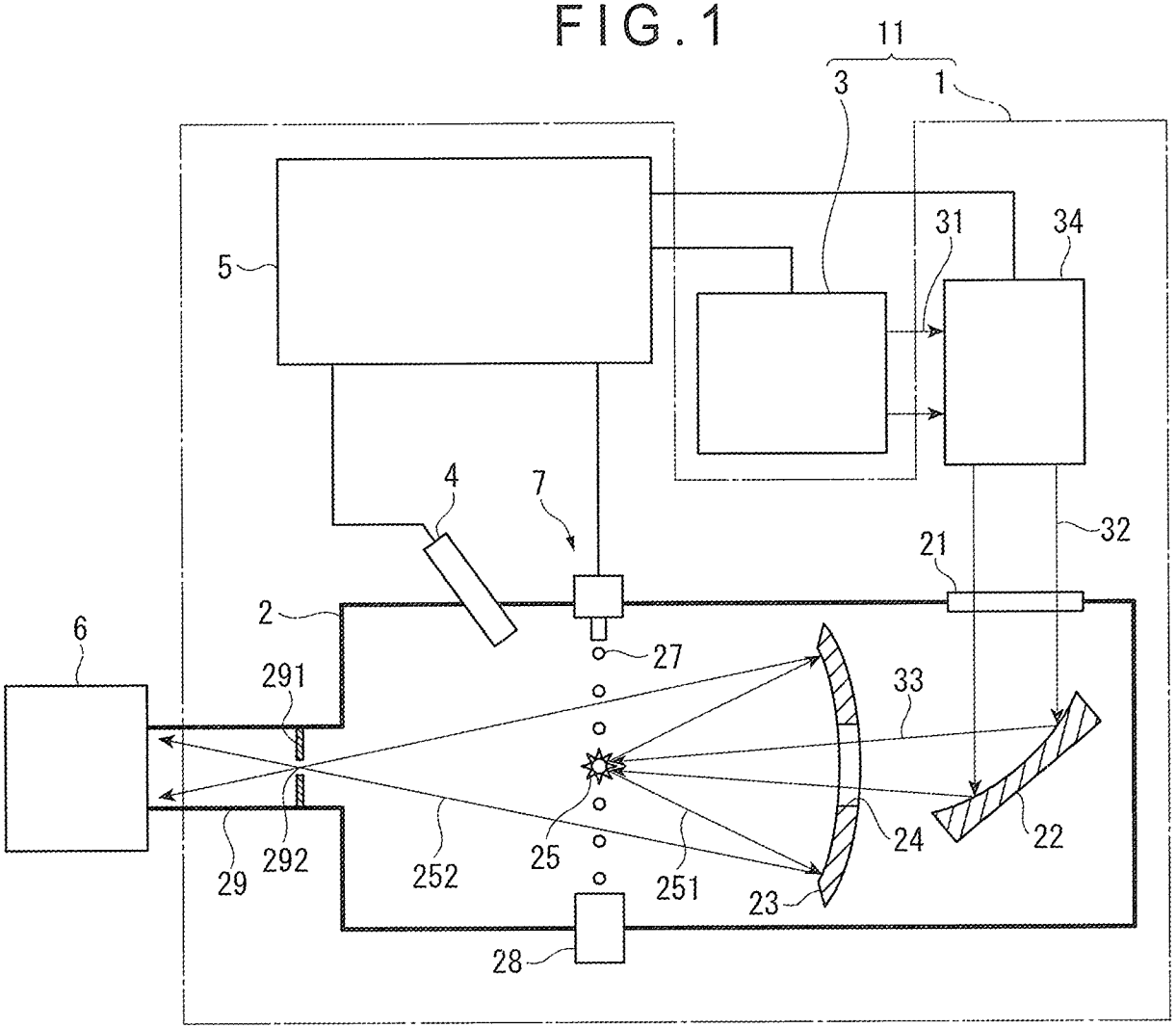
FIG. 1 schematically illustrates an exemplary configuration of an LPP type EUV light generation apparatus.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

CONTENTS

1. Overview
2. Overall Description of EUV Light Generation Apparatus
2.1 Configuration
2.2 Operation
3. EUV Light Generation Apparatus Including Target Supply Device
3.1 First Embodiment
3.1.1 Overview
3.1.2 Configuration 3.1.3 Operation
3.2 Second Embodiment
3.2.1 Overview
3.2.2 Configuration
3.2.3 Operation
3.3 Variation

1. Overview

A control method for a target supply device according to an embodiment of the present disclosure is a control method for a target supply device that is provided in an EUV light generation apparatus and that includes a target generator having a nozzle and holding a target material, a pressure control unit configured to control a pressure within the target generator, and a heating unit configured to heat the target material within the target generator, and the method includes: melting the target material by heating the target material within the target generator using the heating unit; pushing out the target material in the target generator from a nozzle hole in the nozzle by pressurizing the interior of the target generator using the pressure control unit; determining whether or not the size of an adhering area of the target material that forms when the target material is pushed out from the nozzle hole and adheres to a leading end of the nozzle has reached a set size that covers the entire nozzle hole; stopping the pressurization of the interior of the target generator by the pressure control unit when the size of the adhering area has reached the set size; and hardening the target material in the target generator and the adhering area by stopping the heating of the target material by the heating unit.

A target supply device according to an embodiment of the present disclosure may include a target generator and an adhering area. The target generator may have a nozzle and may hold a target material. The adhering area may be composed of the same material as the target material and may adhere to a leading end of the nozzle at a set size that covers the entirety of a nozzle hole of the nozzle.

2. Overview of EUV Light Generation System

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation Apparatus Including Target Supply Device

3.1 First Embodiment

3.1.1 Overview

In a control method for a target supply device according to a first embodiment of the present disclosure, the determining whether or not the size of the adhering area has reached the set size may be carried out by determining that the set size has been reached when an amount of time that has elapsed after the pressure control unit has started pressurizing the interior of the target generator has reached a set time range.

3.1.2 Configuration

Figure 2:
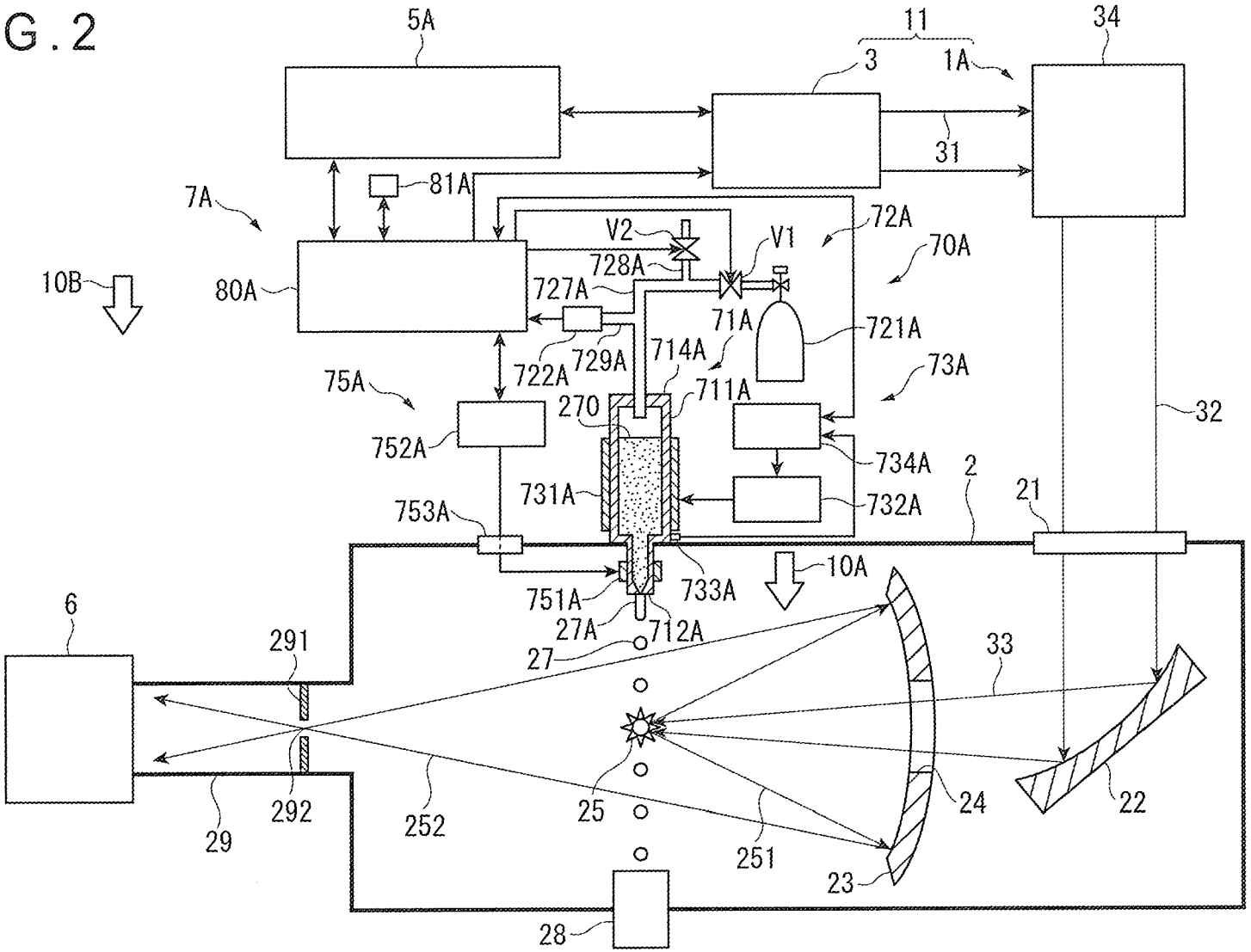
FIG. 2 schematically illustrates the configuration of an EUV light generation apparatus that includes a target supply device according to a first embodiment and a second embodiment.
Figure 3:
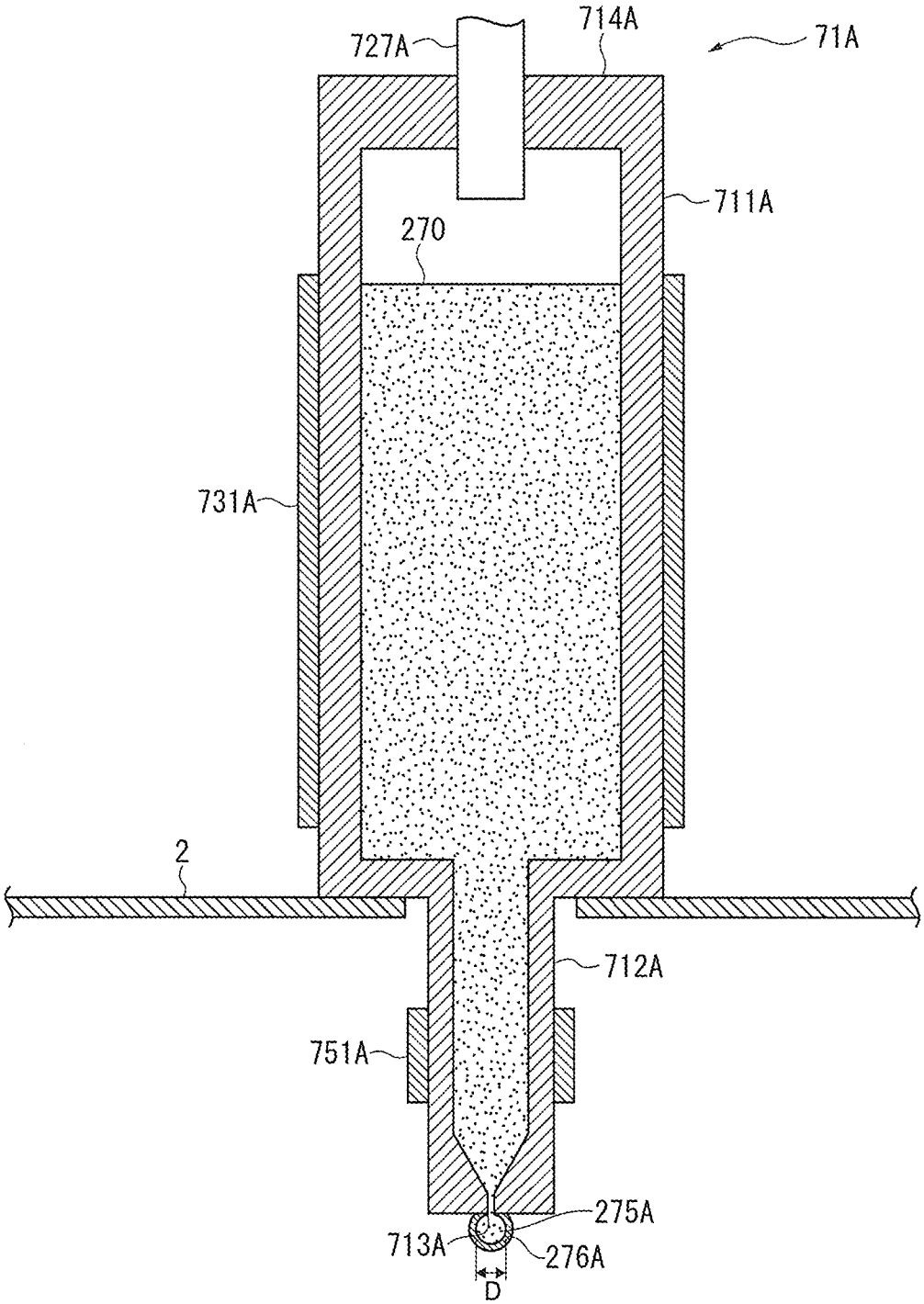
FIG. 3 schematically illustrates the configuration of a target supply device according to the first embodiment.

FIG. 2 schematically illustrates the configuration of an EUV light generation apparatus that includes the target supply device according to a first embodiment as well as a second embodiment that will be described later. FIG. 3 schematically illustrates the configuration of the target supply device according to the first embodiment.

An EUV light generation apparatus 1A may, as shown in FIG. 2, include the chamber 2 and a target supply device 7A. The target supply device 7A may include a target generation section 70A and a target control apparatus 80A serving as a controller. The laser apparatus 3 and an EUV light generation controller 5A may be electrically connected to the target control apparatus 80A.

The target generation section 70A may include a target generator 71A, a pressure control unit 72A, a temperature control section 73A, and a piezoelectric section 75A.

The target generator 71A may include a tank 711A for holding a target material 270 in its interior. The tank 711A may be cylindrical in shape. A nozzle 712A for outputting the target material 270 in the tank 711A to the chamber 2 as the targets 27 may be provided in the tank 711A. A nozzle hole 713A may be provided in a leading end of the nozzle 712A, as shown in FIG. 3. The target generator 71A may be provided so that the tank 711A is positioned outside of the chamber 2 and the nozzle 712A is positioned inside of the chamber 2.

An adhering area 275A that is formed by the target material 270 being pushed out from the nozzle hole 713A may be produced at the leading end of the nozzle 712A. A method for forming this adhering area 275A will be described later. A diameter D of the adhering area 275A may, for example, be within a predetermined set range whose minimum value Dmin is 100 μm and whose maximum value Dmax is 500 μm. A set diameter Dm serving as a median value of the predetermined set range may be 300 μm. The shape of the adhering area 275A need not be a sphere, but can take on a spherical shape due to surface tension in the target material 270 when the target material 270 is pushed out from the nozzle hole 713A.

When the target material 270 that produces the adhering area 275A makes contact with air, solid tin oxide 276A may be produced through a reaction between the oxygen contained in the air and tin at the surface of the adhering area 275A.

Depending on how the chamber 2 is arranged, it is not necessarily the case that a pre-set output direction for the target 27 (the axial direction of the nozzle 712A (called a "set output direction 10A")) will match a gravitational direction 10B. The configuration may be such that the target 27 is outputted horizontally or at an angle relative to the gravitational direction 10B. Note that the first embodiment describes a case in which the chamber 2 may be arranged so that the set output direction 10A and the gravitational direction 10B match.

As shown in FIG. 2, an inert gas bottle 721A may be connected, via a pipe 727A, to an end 714A of the tank 711A. The pipe 727A may be connected at a first end to the inert gas bottle 721A. The pipe 727A may be connected to the end 714A so that a second end of the pipe 727A is located within the tank 711A. Through such a configuration, an inert gas within the inert gas bottle 721A can be supplied to the interior of the target generator 71A.

The pressure control unit 72A may be provided in the pipe 727A. The pressure control unit 72A may include a first valve V1, a second valve V2, and a pressure sensor 722A.

The first valve V1 may be provided in the pipe 727A.

A pipe 728A may be connected to a location of the pipe 727A that is closer to the tank 711A than the first valve V1. The pipe 728A may be connected at a first end to a side surface of the pipe 727A. A second end of the pipe 728A may be open. The second valve V2 may be provided partway along the pipe 728A.

The first valve V1 and the second valve V2 may be gate valves, ball valves, butterfly valves, or the like. The first valve V1 and the second valve V2 may be the same type of valve, or may be different types of valves.

The target control apparatus 80A may be electrically connected to the first valve V1 and the second valve V2. The first valve V1 and the second valve V2 may switch, independent from each other, between open and closed states based on a signal sent from the target control apparatus 80A.

When the first valve V1 opens, an inert gas from the inert gas bottle 721A can be supplied to the interior of the target generator 71A via the pipe 727A. When the second valve V2 closes, the inert gas present in the pipe 727A can be prevented from being discharged to the exterior of the pipe 727A from the second end of the pipe 728A. Accordingly, when the first valve V1 opens and the second valve V2 closes, a pressure in the target generator 71A can rise to the same pressure as the pressure in the inert gas bottle 721A. Thereafter, the pressure in the target generator 71A can be held at the same pressure as the pressure in the inert gas bottle 721A.

When the first valve V1 closes, an inert gas from the inert gas bottle 721A can be prevented from being supplied to the interior of the target generator 71A via the pipe 727A. When the second valve V2 opens, the inert gas present in the pipe 727A can be discharged to the exterior of the pipe 727A from the second end of the pipe 728A as a result of a pressure difference between the interior of the pipe 727A and the exterior of the pipe 727A. Accordingly, when the first valve V1 closes and the second valve V2 opens, the pressure in the target generator 71A can drop.

A pipe 729A may be connected to a location of the pipe 727A that is closer to the tank 711A than the pipe 728A. The pipe 729A may be connected at a first end to a side surface of the pipe 727A. The pressure sensor 722A may be provided in a second end of the pipe 728A. The target control apparatus 80A may be electrically connected to the pressure sensor 722A. The pressure sensor 722A may detect a pressure of the inert gas present in the pipe 729A and may send a signal corresponding to the detected pressure to the target control apparatus 80A. The pressure within the pipe 729A can be essentially the same as the pressure in the pipe 727A and the pressure in the target generator 71A.

The temperature control section 73A may be configured to control the temperature of the target material 270 within the tank 711A. The temperature control section 73A may include a heater 731A, a heater power source 732A, a temperature sensor 733A, and a temperature controller 734A. The heater 731A may be provided on an outer circumferential surface of the tank 711A. The heater power source 732A may cause the heater 731A to produce heat by supplying power to the heater 731A based on a signal from the temperature controller 734A. As a result, the target material 270 within the tank 711A can be heated via the tank 711A.

The temperature sensor 733A may be provided on the outer circumferential surface of the tank 711A, toward the location of the nozzle 712A, or may be provided within the tank 711A. The temperature sensor 733A may be configured to detect a temperature primarily at a location where the temperature sensor 733A is installed as well as the vicinity thereof in the tank 711A, and to send a signal corresponding to the detected temperature to the temperature controller 734A. The temperature at the location where the temperature sensor 733A is installed and at the vicinity thereof can be essentially the same temperature as the temperature of the target material 270 within the tank 711A.

The temperature controller 734A may be configured to output, to the heater power source 732A, a signal for controlling the temperature of the target material 270 to a predetermined temperature, based on a signal from the temperature sensor 733A.

The piezoelectric section 75A may include a piezoelectric element 751A and a power source 752A. The piezoelectric element 751A may be provided on the outer circumferential surface of the nozzle 712A within the chamber 2. Instead of the piezoelectric element 751A, a mechanism capable of applying vibrations to the nozzle 712A at high speeds may be provided. The power source 752A may be electrically connected to the piezoelectric element 751A via a feedthrough 753A. The power source 752A may be electrically connected to the target control apparatus 80A.

The target generation section 70A may generate a jet 27A as a continuous jet, and may be configured so that the targets 27 are produced by vibrating the jet 27A outputted from the nozzle 712A.

The target control apparatus 80A may serve as a controller. A timer 81A may be electrically connected to the target control apparatus 80A. The target control apparatus 80A may control the temperature of the target material 270 in the target generator 71A by sending a signal to the temperature controller 734A. The target control apparatus 80A may control the pressure in the target generator 71A by sending a signal to the first valve V1 and the second valve V2 of the pressure control unit 72A.

3.1.3 Operation

Figure 4A:
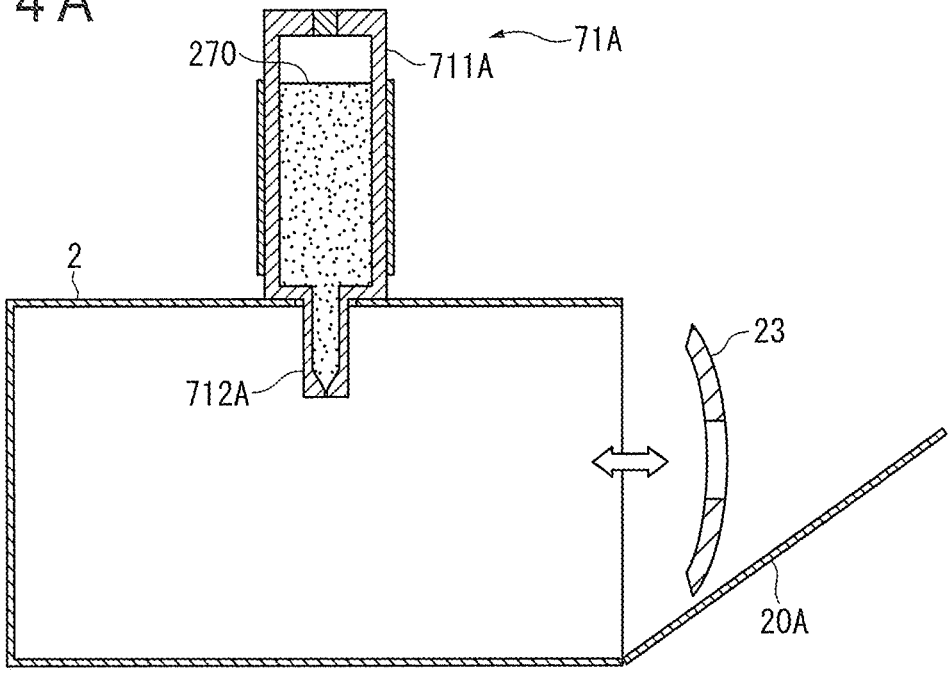
FIG. 4A is a diagram illustrating an issue in an embodiment of the present disclosure, and illustrates operations carried out when performing maintenance on a component within a chamber.
Figure 4B:
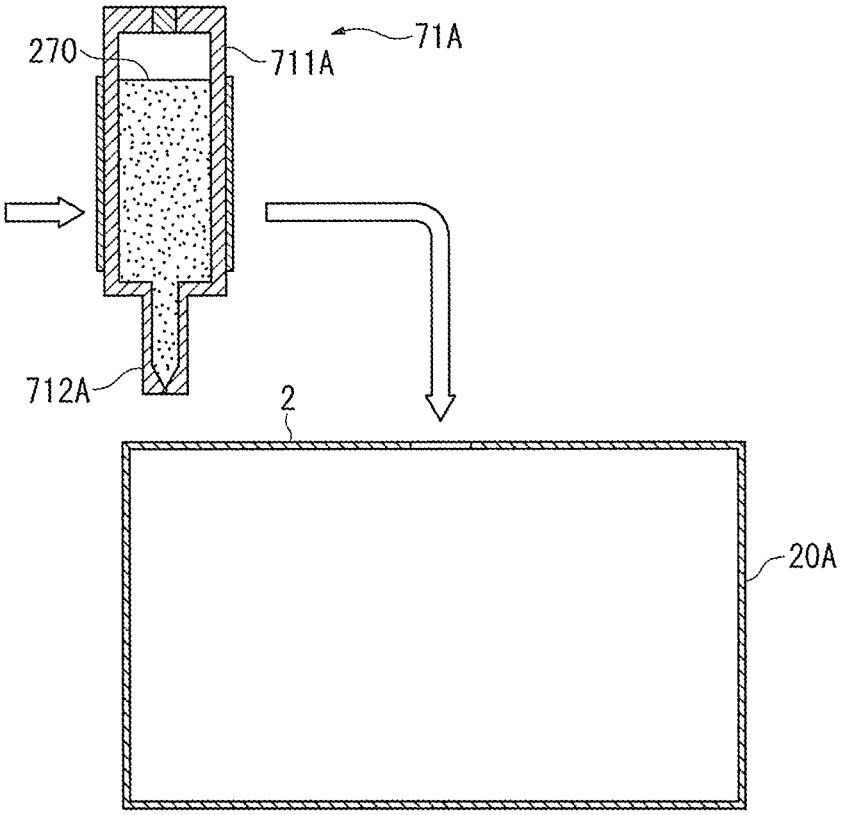
FIG. 4B is a diagram illustrating the aforementioned issue, and indicates operations carried out when setting a target supply device that has undergone maintenance or a new target supply device in a chamber.
Figure 5A:
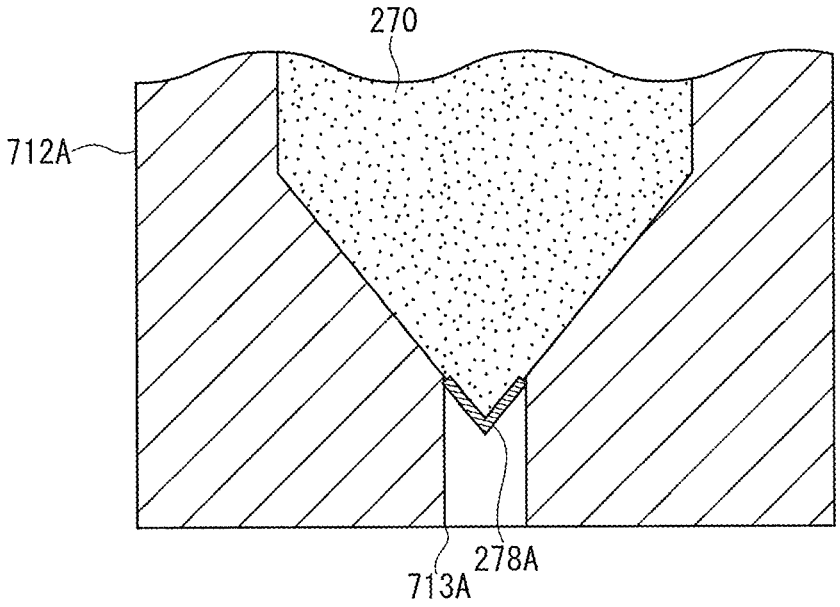
FIG. 5A is a diagram illustrating the aforementioned issue, and indicates a state in which tin oxide has been formed in a leading end area of a target material within a nozzle.
Figure 5B:
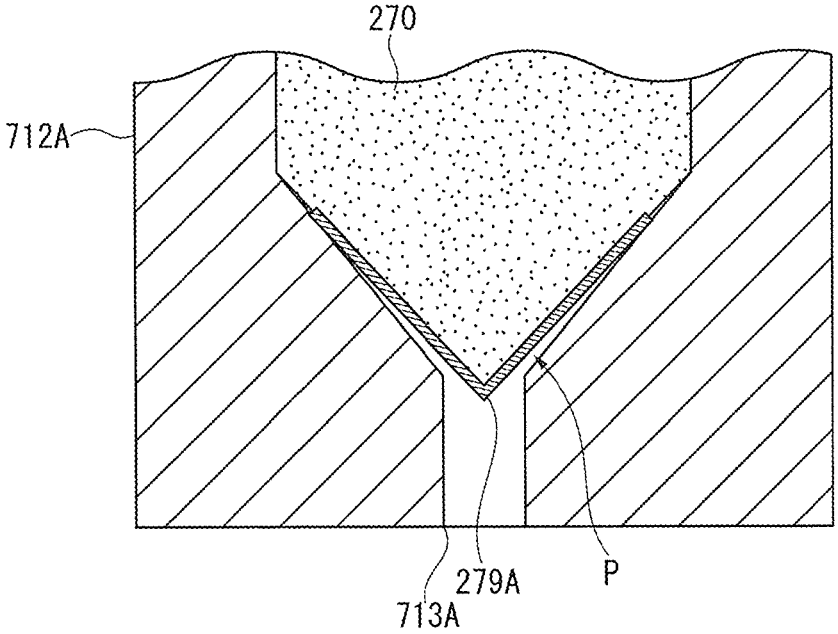
FIG. 5B is a diagram illustrating the aforementioned issue, and indicates a state in which a target material has contracted and tin oxide has been formed in a leading end area of a target material within a nozzle.
Figure 6:
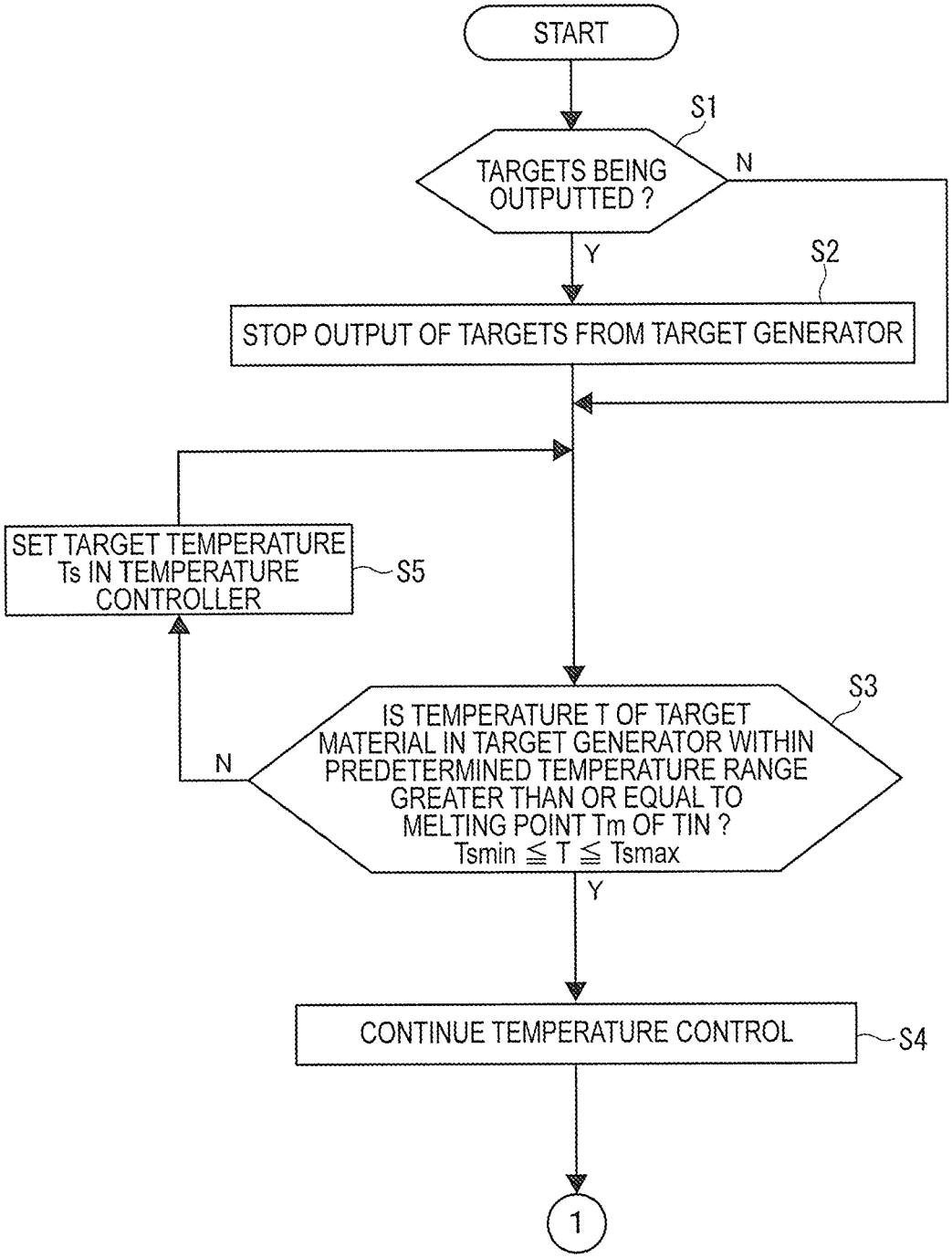
FIG. 6 is a flowchart illustrating a control method for the target supply device according to the first embodiment.
Figure 7:
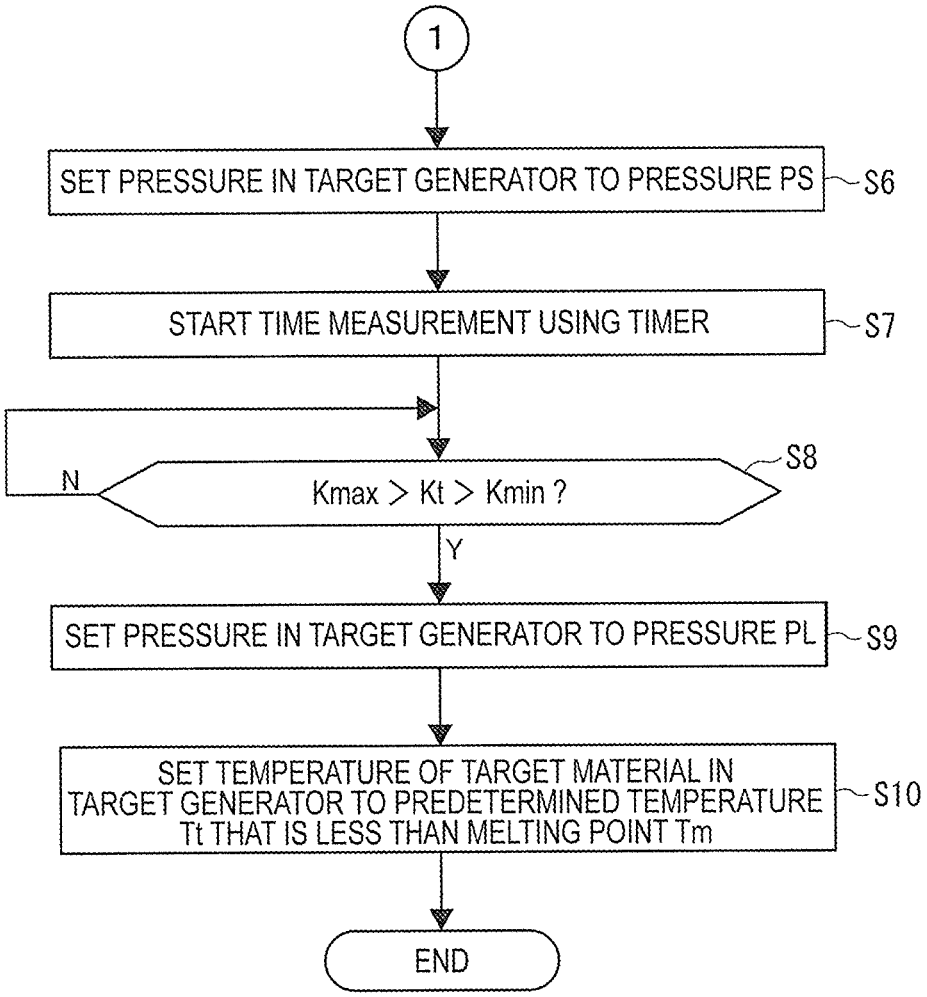
FIG. 7 is a flowchart illustrating a control method for the target supply device, and illustrates a process continuing from that shown in FIG. 6.

FIG. 4A is a diagram illustrating an issue in an embodiment of the present disclosure, and illustrates operations carried out when performing maintenance on a component within a chamber. FIG. 4B is a diagram illustrating the aforementioned issue, and indicates operations carried out when setting a target supply device that has undergone maintenance or anew target supply device in the chamber. FIG. 5A is a diagram illustrating the aforementioned issue, and indicates a state in which tin oxide has been formed in a leading end area of a target material within a nozzle. FIG. 5B is a diagram illustrating the aforementioned issue, and indicates a state in which the target material has contracted and tin oxide has been formed in the leading end area of the target material within the nozzle. FIG. 6 is a flowchart illustrating a control method for a target supply device. FIG. 7 is a flowchart illustrating the control method for a target supply device, and illustrates a process continuing from that shown in FIG. 6.

Note that the following describes a control method for a target supply device using, as an example, a case where the target material 270 is tin.

An issue that the control method for a target supply device of the first embodiment and the second embodiment solves will now be described.

An operator of the EUV light generation apparatus 1 may open a door 20A of the chamber 2 and remove the EUV collector mirror 23 to the exterior of the chamber 2 or insert the EUV collector mirror 23 into the chamber 2, as shown in FIG. 4A. When the door 20A is opened, air can enter into the chamber 2 and make contact with the nozzle 712A.

The operator of the EUV light generation apparatus 1 may remove the target generator 71A from the chamber 2 and perform maintenance on the target generator 71A. As shown in FIG. 4B, the operator may reinstall the target generator 71A that has undergone maintenance in the chamber 2. During maintenance on the target generator 71A, or when removing the target generator 71A from the chamber 2, the nozzle 712A can come into contact with air.

The target material 270 within the target generator 71A may harden before opening the door 20A of the chamber 2 as shown in FIG. 4A or before removing the target generator 71A from the chamber 2 as shown in FIG. 4B.

For example, the target control apparatus 80A may control the pressure in the target generator 71A to a pressure at which the targets 27 are not outputted. This pressure control may be carried out by controlling the first valve V1 and the second valve V2 to open and close. The target control apparatus 80A may stop the driving of the piezoelectric element 751A. Through this processing, the pressure in the target generator 71A can drop to a pressure at which the targets 27 are not outputted, and the output of the targets 27 can be stopped. The target control apparatus 80A may stop the heating of the target material 270. The target material 270 can harden when the temperature of the target material 270 drops below the melting point of the target material 270 or lower.

As shown in FIG. 5A, through the aforementioned operations, the target material 270 can harden in a state where an end area of the target material 270 is located higher than the leading end of the nozzle 712A, or in other words, in a state in which the end area of the target material 270 is located inside the nozzle 712A. When, in the state shown in FIG. 5A, the nozzle 712A makes contact with air, the end area of the target material 270 positioned within the nozzle 712A can form solid tin oxide 278A.

Meanwhile, in the case where the target material 270 has contracted as the target material 270 hardens, a gap P can be formed between an inner wall surface of the nozzle 712A and the target material 270, as shown in FIG. 5B. When the nozzle 712A makes contact with air in the state shown in FIG. 5A, solid tin oxide 279A can be formed at an end area of the target material 270 positioned within the nozzle 712A, including an area that faces the gap P.

The issue described hereinafter can arise when the target generator 71A, in which the solid tin oxide 278A, 279A has formed within the nozzle 712A, is reattached to the chamber 2 and outputs the targets 27. In order to output the targets 27, the target material 270 may be heated until the target material 270 melts. Because the melting point of the solid tin oxide 278A, 279A is higher than the melting point of non-oxidized tin, the tin oxide 278A, 279A can remain in a solid state without melting even if enough heat is applied to melt the non-oxidized target material 270. The solid tin oxide 278A, 279A remaining within the nozzle 712A can clog the nozzle hole 713A, can cause the targets 27 to be outputted in unintended directions, and so on.

In order to solve such an issue, a control method for a target supply device shown in FIG. 6 and FIG. 7 may be carried out prior to the nozzle 712A making contact with air.

In a state where the nozzle 712A is located within the chamber 2 and the interior of the chamber 2 is in a vacuum state, the target control apparatus 80A of the target supply device 7A may, as shown in FIG. 6, determine whether or not targets 27 are being outputted from the target generator 71A (step S1). In the case where it has been determined in step S1 that the targets 27 are being outputted, the target control apparatus 80A may stop the output of the targets 27 from the target generator 71A (step S2).

The target control apparatus 80A may close the first valve V1 and open the second valve V2 of the pressure control unit 72A by sending signals to the first valve V1 and the second valve V2. The pressure sensor 722A may detect the pressure in the target generator 71A every predetermined amount of time. The pressure sensor 722A may send, to the target control apparatus 80A, a signal corresponding to the detected pressure each time the pressure is detected. The target control apparatus 80A may close the second valve V2 when it has been determined that the pressure in the target generator 71A has reached a pressure at which the targets 27 will not be outputted. The target control apparatus 80A may open the first valve V1 so that the pressure in the target generator 71A is held at a pressure at which the targets 27 will not be outputted. The target control apparatus 80A may stop the driving of the piezoelectric element 751A by sending a signal to the power source 752A.

Through this processing, the pressure in the target generator 71A can drop to a pressure at which the targets 27 are not outputted, and the output of the targets 27 can be stopped.

The target control apparatus 80A may determine whether or not a temperature T of the target material 270 within the target generator 71A is within a predetermined temperature range greater than or equal to a melting point Tm of tin (step S3). The melting point Tm of tin may be 232° C. The predetermined temperature range may be greater than or equal to a minimum temperature Tsmin and equal to or less than a maximum temperature Tsmax. A target temperature Ts, corresponding to a median value of the predetermined temperature range, may be 350° C.

When it is determined in step S3 that the temperature of the target material 270 is within the predetermined temperature range, the target control apparatus 80A may continue this temperature control as-is (step S4). On the other hand, when it is determined in step S3 that the temperature of the target material 270 is not within the predetermined temperature range, the target control apparatus 80A may set the target temperature Ts in the temperature controller 734A (step S5). In the case where the temperature T is lower than the minimum temperature Tsmin when the process of step S5 is carried out, the temperature of the target material 270 can rise. In the case where the temperature T is higher than the maximum temperature Tsmax, the temperature of the target material 270 can drop. After the process of step S5 has been carried out, the target control apparatus 80A may carry out the process of step S4.

However, in the case where the target supply device 7A is undergoing maintenance and the target supply device 7A is not outputting the targets 27, the target control apparatus 80A can determine in step S1 that the targets 27 are not being outputted. Thereafter, the target control apparatus 80A may carry out the processes of step S3 and step S4 without carrying out the process of step S2. When it is determined in step S3 that the temperature of the target material 270 is within the predetermined temperature range, the target control apparatus 80A can carry out the process of step S4.

The target control apparatus 80A may set the pressure in the target generator 71A to a pressure PS by sending a signal to the first valve V1 of the pressure control unit 72A, as shown in FIG. 7 (step S6). The pressure PS may be greater than the pressure in the target generator 71A at the point in time when the process of step S6 is carried out. When raising the pressure in the target generator 71A from the current pressure to the pressure PS, the target control apparatus 80A may open the first valve V1. Through this, the pressure in the target generator 71A can rise to the pressure PS.

When the pressure in the target generator 71A reaches the pressure PS, the target material 270 may break the surface tension of the target material 270 at the nozzle hole 713A. As a result, the target material 270 can be pushed out from the nozzle hole 713A. In other words, step S6 may be a process of pressurizing the interior of the target generator 71A. In the case where the nozzle hole 713A is 10 μm in diameter, the pressure PS may be 0.25 MPa.

The target control apparatus 80A may start measuring time using the timer 81A (step S7). The target control apparatus 80A may determine whether or not a measured time Kt measured by the timer 81A is both longer than a minimum time Kmin and shorter than a maximum time Kmax (step S8).

When the pressure in the target generator 71A reaches the pressure PS as a result of the process performed in step S6, the target material 270 can be pushed out from the nozzle hole 713A and the spherical adhering area 275A can be formed. The adhering area 275A can gradually grow (that is, can gradually develop) while the piezoelectric element 751A is stopped and the pressure in the target generator 71A is held at the pressure PS.

In the case where the measured time Kt is shorter than the minimum time Kmin, the pressure in the target generator 71A is held at the pressure PS for a short amount of time, and thus a diameter D of the adhering area 275A can become smaller than a minimum value Dmin. As a result, a state in which the entire nozzle hole 713A is not covered by the adhering area 275A can arise. On the other hand, in the case where the measured time Kt is longer than the maximum time Kmax, the pressure in the target generator 71A is held at the pressure PS for a long amount of time, and thus the diameter D of the adhering area 275A can become greater than a maximum value Dmax. As a result, the adhering area 275A can fall from the nozzle 712A under its own weight. Based on this, in the case where the standard of the determination in step S8 has been met, a state in which the adhering area 275A whose diameter D is within a predetermined set range adheres to the leading end of the nozzle 712A can be achieved.

Note that the minimum time Kmin and the maximum time Kmax may be determined in advance through experimentation, using a method that employs a target sensor 4B described later in the second embodiment. In other words, for example, the target sensor 4B may detect the gradually increasing diameter D of the adhering area 275A after the target control apparatus 80A has performed the processes of step S1 to step S7. The target control apparatus 80A may store a relationship between the measured time Kt and the diameter D of the adhering area 275A in a memory (not shown). The operator may then determine the minimum time Kmin and the maximum time Kmax based on the data stored in this memory.

The minimum time Kmin and the maximum time Kmax may be several seconds to several tens of seconds. The minimum time Kmin and the maximum time Kmax may each be different lengths depending on the diameter of the nozzle hole 713A in the nozzle 712A, the composition of the target material 270, and so on.

In the case where it has been determined that the standard for the determination in step S8 is not met, the target control apparatus 80A may carry out the process of step S8 again after a predetermined amount of time has elapsed. On the other hand, in the case where it has been determined that the standard for the determination in step S8 is met, the target control apparatus 80A may set the pressure in the target generator 71A to a pressure PL (step S9). The pressure PL may be lower than the pressure PS. The pressure PL may, for example, be equal to or less than atmospheric pressure, and may be 0.05 MPa. When lowering the pressure in the target generator 71A from the pressure PS to the pressure PL, the target control apparatus 80A may close the first valve V1 and open the second valve V2. Upon determining based on a signal from the pressure sensor 722A that the pressure in the target generator 71A has reached the pressure PL, the target control apparatus 80A may close the second valve V2. The target control apparatus 80A may open the first valve V1 so that the pressure in the target generator 71A is held at the pressure PL.

By controlling the second valve V2 and utilizing a pressure difference between the interior of the pipe 727A and the exterior of the pipe 727A, the time required to lower the pressure in the target generator 71A from the pressure PS to the pressure PL can be one minute or greater.

The pressure in the target generator 71A can drop and the target material 270 can be stopped from being pushed out from the nozzle hole 713A as a result of the process of step S9. As a result, the adhering area 275A can be suppressed from growing, and the adhering area 275A whose size is within a set range that covers the entire nozzle hole 713A can be formed at the leading end of the nozzle 712A.

The target control apparatus 80A may set the temperature of the target material 270 in the target generator 71A to a predetermined temperature Tt that is less than the melting point Tm by sending a signal to the temperature controller 734A (step S10). The temperature Tt may be, for example, room temperature (20° C. to 30° C.)

The temperature of the target material 270 in the target generator 71A and the adhering area 275A adhering to the leading end of the nozzle 712A can drop to the temperature Tt as a result of the process of step S10. Accordingly, the target material 270 in the target generator 71A and the adhering area 275A can harden.

After this, the operator may raise the pressure in the chamber 2 to atmospheric pressure by operating the EUV light generation apparatus 1, in order to perform maintenance on the EUV collector mirror 23, for example. The operator may open the door 20A of the chamber 2 after the pressure in the chamber 2 has reached atmospheric pressure, as shown in FIG. 4A. When the door 20A opens, air can enter into the chamber 2 and make contact with the nozzle 712A. At this time, the air can make contact with the adhering area 275A adhering to the leading end of the nozzle 712A, and the solid tin oxide 276A can form on the surface of the adhering area 275A. Because the adhering area 275A adheres to the leading end of the nozzle 712A so as to cover the nozzle hole 713A, the tin oxide 276A can be prevented from forming inside of the nozzle 712A.

As described above, by forming the adhering area 275A in the target generator 71A, the tin oxide 276A can be suppressed from remaining in the nozzle 712A, and problems such as the nozzle hole 713A clogging, the targets 27 being outputted in unintended directions, and so on can be suppressed. As a result, the target supply device 7A can output the targets 27 properly.

The target control apparatus 80A can control the size of the adhering area 275A to an appropriate size through a simple method of simply monitoring the measured time Kt.

3.2 Second Embodiment

3.2.1 Overview

In a control method for a target supply device according to a second embodiment of the present disclosure, the EUV light generation apparatus may further include a measurement unit that is configured to measure the size of the adhering area, and the determining whether or not the size of the adhering area has reached the set size may be carried out by measuring the size of the adhering area using the measurement unit and determining whether or not the size of the adhering area has reached the set size based on a result of the measurement.

In the control method for the target supply device according to the second embodiment of the present disclosure, the EUV light generation apparatus may further include an exhaust unit that is configured to exhaust the interior of the target generator by applying suction to the interior of the target generator, and the method may further include exhausting the interior of the target generator using the exhaust unit after the pressurization of the interior of the target generator by the pressure control unit has stopped and before the heating of the target material by the heating unit has stopped.

In the control method for the target supply device according to the second embodiment of the present disclosure, stopping the heating of the target material by the heating unit may be carried out by reducing the temperature of the target material while maintaining a state in which the temperature of the target material that is closer to the leading end of the nozzle is lower than the temperature of the target material that is further from the leading end of the nozzle.

3.2.2 Configuration

Figure 8:
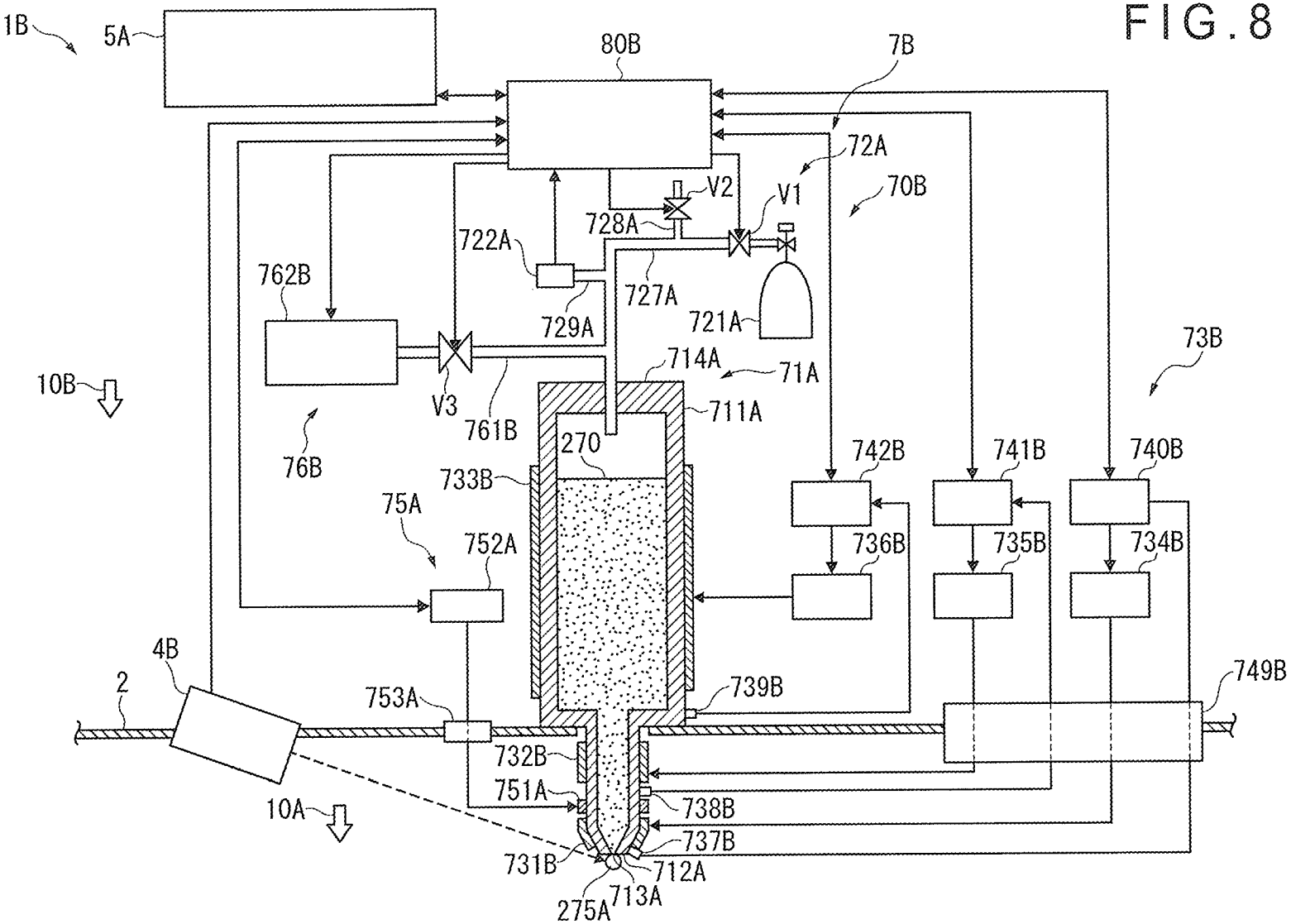
FIG. 8 schematically illustrates the configuration of the target supply device according to the second embodiment.

FIG. 8 schematically illustrates the configuration of the target supply device according to the second embodiment.

As shown in FIG. 8, an EUV light generation apparatus 1B according to the second embodiment may employ the same configuration as the EUV light generation apparatus 1A of the first embodiment, with the exception of a target generation section 70B of a target supply device 7B, a target control apparatus 80B, and a measurement unit indicated by 4B.

In the second embodiment, the chamber 2 may be arranged so that the set output direction 10A and the gravitational direction 10B match.

The target sensor 4B may be electrically connected to the target control apparatus 80B.

The target generation section 70B may include the target generator 71A, the pressure control unit 72A, a temperature control section 73B serving as a heating unit, the piezoelectric section 75A, and an exhaust section 76B.

The temperature control section 73B may include a first heater 731B, a second heater 732B, a third heater 733B, a first heater power source 734B, a second heater power source 735B, a third heater power source 736B, a first temperature sensor 737B, a second temperature sensor 738B, a third temperature sensor 739B, a first temperature controller 740B, a second temperature controller 741B, and a third temperature controller 742B.

The first heater 731B may be provided on the outer circumferential surface on the leading end side of the nozzle 712A. The second heater 732B may be provided on the outer circumferential surface of the nozzle 712A above the first heater 731B (for example, on the opposite side thereof to the gravitational direction 10B). The third heater 733B may be provided on the outer circumferential surface on the lower end side (the side toward the nozzle 712A) of the tank 711A. In other words, the first to third heaters 731B to 733B may be provided so as to be arranged in order in the set output direction 10A of the target material 270.

The first heater 731B and the second heater 732B may respectively be electrically connected to the first heater power source 734B and the second heater power source 735B via a feedthrough 749B. The third heater 733B may be electrically connected to the third heater power source 736B.

The first temperature sensor 737B may be provided on the nozzle 712A lower than the first heater 731B (that is, toward the leading end of the nozzle 712A). The second temperature sensor 738B may be provided on the nozzle 712A lower than the second heater 732B. The third temperature sensor 739B may be provided on the tank 711A lower than the third heater 733B.

The first temperature sensor 737B and the second temperature sensor 738B may respectively be electrically connected to the first temperature controller 740B and the second temperature controller 741B via the feedthrough 749B. The third temperature sensor 739B may be electrically connected to the third temperature controller 742B.

The first temperature sensor 737B may detect a temperature primarily at a location where the first temperature sensor 737B is installed as well as the vicinity thereof in the nozzle 712A, and may send a signal corresponding to the detected temperature to the first temperature controller 740B. The temperature at the location where the first temperature sensor 737B is installed as well as the vicinity thereof can be essentially the same temperature as primarily the area of the target material 270 in the nozzle 712A that is heated by the first heater 731B.

The second temperature sensor 738B may detect a temperature primarily at a location where the second temperature sensor 738B is installed as well as the vicinity thereof in the nozzle 712A, and may send a signal corresponding to the detected temperature to the second temperature controller 741B. The temperature at the location where the second temperature sensor 738B is installed as well as the vicinity thereof can be essentially the same temperature as primarily the area of the target material 270 in the nozzle 712A that is heated by the second heater 732B.

The third temperature sensor 739B may detect a temperature primarily at a location where the third temperature sensor 739B is installed as well as the vicinity thereof in the tank 711A, and may send a signal corresponding to the detected temperature to the third temperature controller 742B. The temperature at the location where the third temperature sensor 739B is installed as well as the vicinity thereof can be essentially the same as the temperature of the target material 270 within the tank 711A.

The exhaust section 76B may include a pipe 761B, an exhaust apparatus 762B, and a third valve V3.

A first end of the pipe 761B may be connected to a side surface of the pipe 727A that is closer to the tank 711A than the pipe 729A.

The exhaust apparatus 762B may be connected to a second end of the pipe 761B. The exhaust apparatus 762B may be electrically connected to the target control apparatus 80B. The exhaust apparatus 762B may exhaust the interior of the target generator 71A by applying suction to the interior of the pipe 761B based on a signal sent from the target control apparatus 80B.

The third valve V3 may be provided in the pipe 761B. The third valve V3 may be a gate valve, a ball valve, a butterfly valve, or the like. The third valve V3 may be electrically connected to the target control apparatus 80B. The third valve V3 may switch between open and closed states based on a signal sent from the target control apparatus 80B.

3.2.3 Operation

Figure 9:
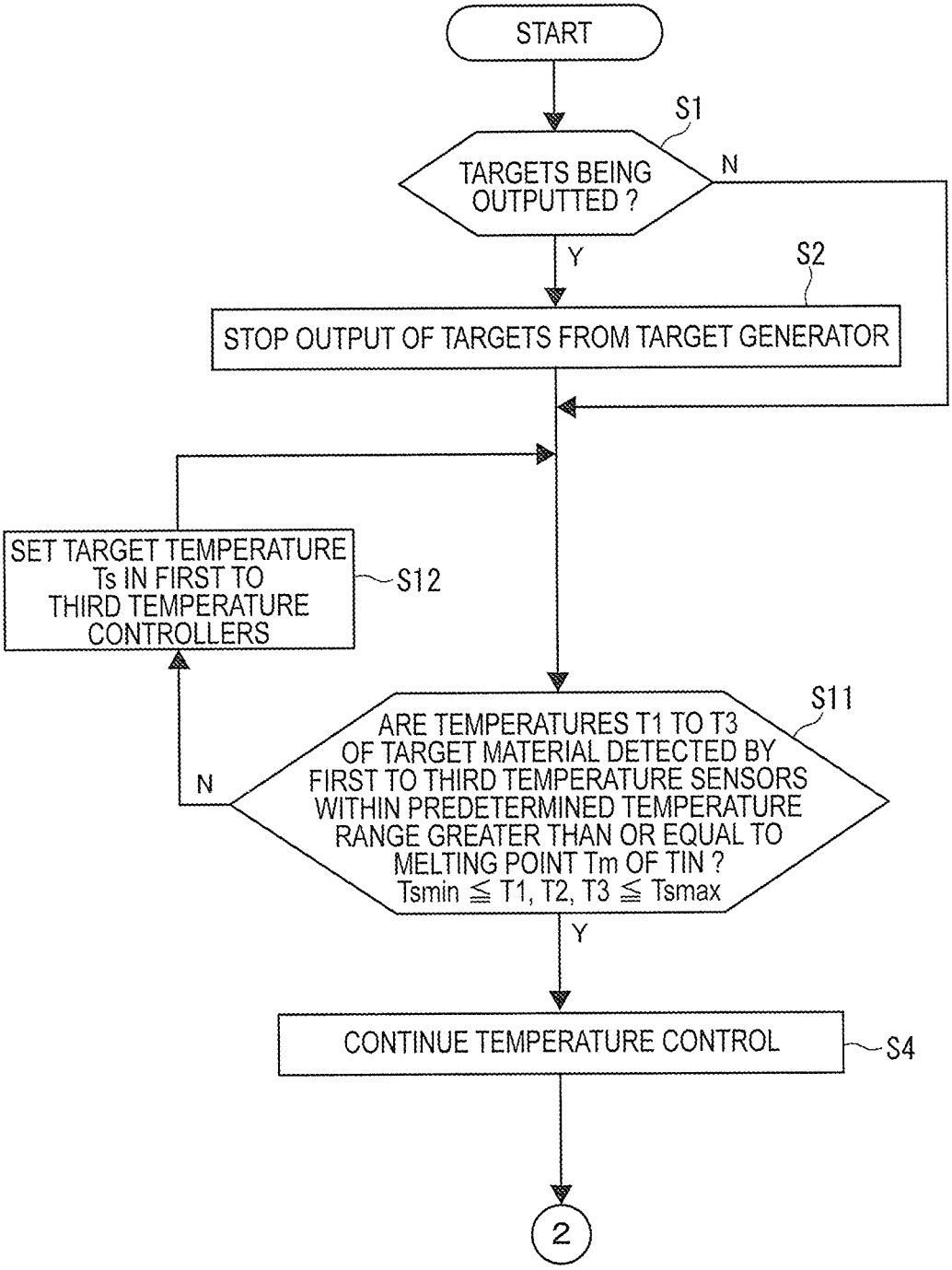
FIG. 9 is a flowchart illustrating a control method for the target supply device according to the second embodiment.
Figure 10:
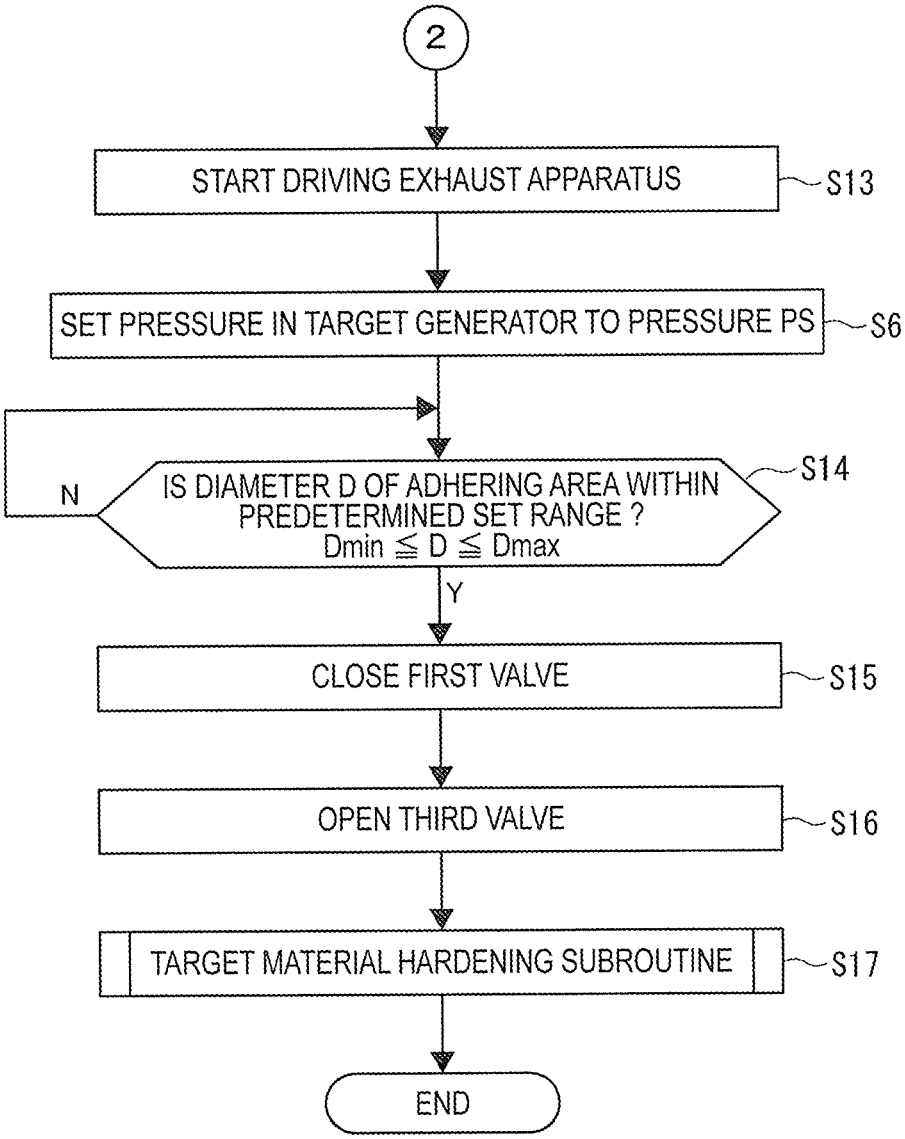
FIG. 10 is a flowchart illustrating a control method for the target supply device, and illustrates a process continuing from that shown in FIG. 9.
Figure 11:
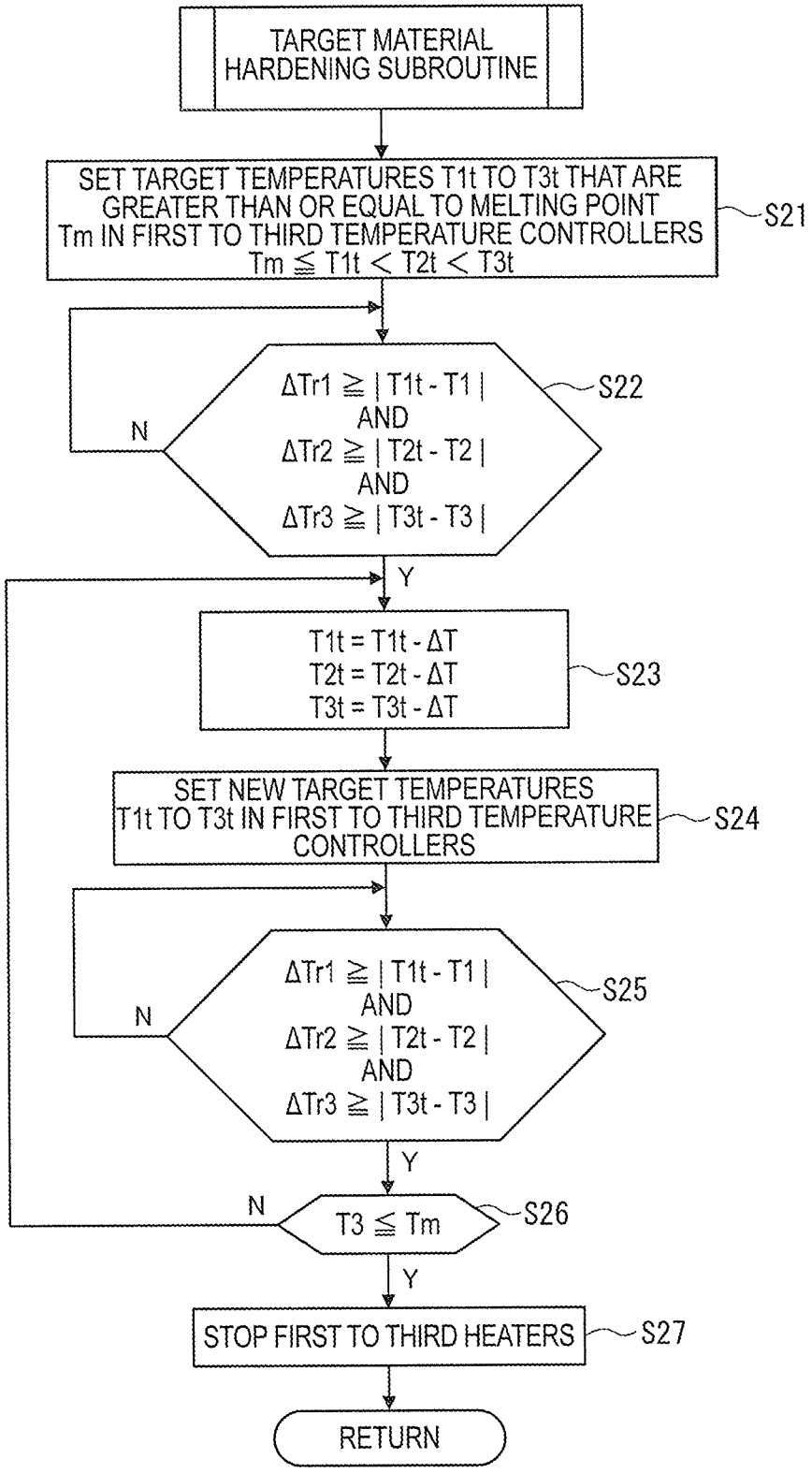
FIG. 11 is a flowchart illustrating a target material hardening subroutine according to the second embodiment.

In the following, descriptions of operations identical to those in the first embodiment will be omitted. FIG. 9 is a flowchart illustrating a control method for a target supply device. FIG. 10 is a flowchart illustrating the control method for the target supply device, and illustrates a process continuing from that shown in FIG. 9. FIG. 11 is a flowchart illustrating a target material hardening subroutine.

The target control apparatus 80B of the target supply device 7B may carry out the processes of step S1 and step S2, as shown in FIG. 9.

After the process of step S1, in the case where the targets 27 are being outputted, the target control apparatus 80B can carry out the process of step S2. Thereafter, the target control apparatus 80B may determine whether or not temperatures T1, T2, and T3 of the target material 270 in the target generator 71A detected by the first to third temperature sensors 737B to 739B, respectively, are within a predetermined temperature range greater than or equal to the melting point Tm of tin (step S11). The predetermined temperature range and the target temperature Ts, corresponding to a median value of the predetermined temperature range, may be the same range and value as those in step S5 of the first embodiment.

When it has been determined in step S11 that the temperatures T1 to T3 of the target material 270 detected by the first to third temperature sensors 737B to 739B are within the predetermined temperature range, the target control apparatus 80B may carry out the process of step S4 (that is, may continue the temperature control as-is). On the other hand, when it is determined in step S11 that the temperatures T1 to T3 are not within the predetermined temperature range, the target control apparatus 80B may set the target temperature Is in the first to third temperature controllers 740B to 742B (step S12). The same value may be set in the first to third temperature controllers 740B to 742B as the target temperature Ts. In the case where the temperatures T1 to T3 are lower than the minimum temperature Tsmin when the process of step S12 is carried out, the temperature of the target material 270 can rise. In the case where the temperatures T1 to T3 are higher than the maximum temperature Tsmax, the temperature of the target material 270 can drop. After the process of step S12 has been carried out, the target control apparatus 80B may carry out the process of step S4.

The target control apparatus 80B can carry out the processes of step S11 and step S4 after the process of step S1, without carrying out the process of step S2, in the case where the targets 27 are not being outputted. When it is determined in step S11 that the temperatures T1 to T3 are not within the predetermined temperature range, the target control apparatus 80B can carry out the process of step S12.

The target control apparatus 80B may start driving the exhaust apparatus 762B, as shown in FIG. 10 (step S13). At this time, the third valve V3 may be closed. Through this, the pipe 727A and the interior of the target generator 71A can be suppressed from being exhausted by the exhaust apparatus 762B despite the exhaust apparatus 762B being driven.

The target control apparatus 80B may carry out the process of step S6 and set the pressure in the target generator 71A to the pressure PS. As a result of the process of step S6, the target material 270 can be pushed out from the nozzle hole 713A, and the spherical adhering area 275A can be formed. The adhering area 275A can then gradually grow. Note that in order to hold the pressure in the target generator 71A at the pressure PS while the adhering area 275A is growing in step S6, the first valve V1 can be opened to a degree corresponding to the pressure PS and the second valve V2 can be closed.

The target control apparatus 80B may determine whether or not the diameter D of the adhering area 275A is within a predetermined set range (step S14). The predetermined set range may be greater than or equal to the minimum value Dmin and equal to or less than the maximum value Dmax. The minimum value Dmin, the maximum value Dmax, and the set diameter Dm serving as the median value of the predetermined set range may be the same values as in the first embodiment.

The target sensor 4B may detect the diameter D of the gradually-growing adhering area 275A and may send a signal corresponding to the detection result to the target control apparatus 80B. The target sensor 4B may detect the diameter D every predetermined amount of time. Based on the signal sent from the target sensor 4B, the target control apparatus 80B may determine whether or not the diameter D of the adhering area 275A is within the predetermined set range.

In the case where it has been determined that the standard for the determination in step S14 is not met, the target control apparatus 80B may carry out the process of step S14 again after a predetermined amount of time has elapsed. However, in the case where it has been determined that the standard for the determination in step S14 is met, the target control apparatus 80B may close the first valve V1 (step S15). The target control apparatus 80B may open the third valve V3 (step S16).

By closing the first valve V1, the inert gas can be prevented from being supplied to the target generator 71A. In addition, by opening the third valve V3, the interior of the target generator 71A can be exhausted by the exhaust apparatus 762B that is being driven, and the pressure in the target generator 71A can drop. Upon determining that the pressure in the target generator 71A has reached the pressure PL, the target control apparatus 80B may close the third valve V3 and stop the exhaust apparatus 762B. The target control apparatus 80B may open the first valve V1 so that the pressure in the target generator 71A is held at the pressure PL.

Thus, the exhaust apparatus 762B can exhaust the target generator 71A by applying suction to the interior of the target generator 71A. Accordingly, the pressure in the target generator 71A can drop and the growth of the adhering area 275A can be stopped earlier than when employing a configuration that reduces the pressure in the target generator 71A using a pressure difference between the interior of the pipe 727A and the exterior of the pipe 727A arising when the second valve V2 is opened. The amount of time required to reduce the pressure in the target generator 71A from the pressure PS to the pressure PL can become several seconds.

The target control apparatus 80B may then carry out processing based on the target material hardening subroutine (step S17), and the control process may then be ended. The adhering area 275A can harden as a result of the process of step S17.

The target control apparatus 80B may set target temperatures T1*t* to T3*t* that are greater than or equal to the melting point Tm in the first to third temperature controllers 740B to 742B, as shown in FIG. 11 (step S21). Among the target temperatures T1*t* to T3*t*, the target temperature T1*t* may be the lowest and the target temperature T3*t* may be the highest. A temperature difference between the respective target temperatures T1*t* to T3*t* may, for example, be approximately 10° C. For example, the target temperatures T1*t*, T2*t*, and T3*t* may be 330° C., 340° C., and 350° C., respectively.

The target control apparatus 80B may then determine whether or not all of the conditions in the following Formulas (1) to (3) are met (step S22).

$$\Delta Tr1 \geq |T1t - T1| \quad (1)$$

$$\Delta Tr2 \geq |T2t - T2| \quad (2)$$

$$\Delta Tr3 \geq |T3t - T3| \quad (3)$$

ΔTr1, ΔTr2, ΔTr3: permissible ranges of temperature control as a result of control In other words, the target control apparatus 80B may determine whether or not the temperatures T1 to T3 detected by the first to third temperature sensors 737B to 739B are essentially the same as the target temperatures T1*t* to T3*t*.

Here, the permissible ranges ΔTr1 to ΔTr3 (ΔTr1, ΔTr2, and ΔTr3) may, for example, be any temperature within a range from greater than or equal to 1° C. to equal to or less than 3° C. Meanwhile, the permissible ranges ΔTr1 to ΔTr3 may be the same to each other, or may be different.

In the case where the target control apparatus 80B has determined in step S22 that at least one of the conditions of Formulas (1) to (3) has not been met, the process of step S22 may be carried out again after a predetermined amount of time has elapsed. On the other hand, in the case where it has been determined in step S22 that all of the conditions of Formulas (1) to (3) have been met, the target control apparatus 80B may set, as a new target temperature T1*t*, a temperature obtained by subtracting a temperature ΔT from the target temperature T1*t* currently set in the first heater 731B. Likewise, the target control apparatus 80B may set, as new target temperatures T2*t* and T3*t*, temperatures obtained by subtracting the temperature ΔT from the target temperatures T2*t* and T3*t*, respectively, set in the second and third heaters 732B and 733B (step S23). This temperature ΔT may, for example, be any temperature within a range from greater than or equal to 5° C. to equal to less than 10° C.

Next, the target control apparatus 80B may set the new target temperatures T1*t* to T3*t* in the first to third temperature controllers 740B to 742B (step S24). When the process of step S24 is carried out, the amounts of heat emitted by the first to third heaters 731B to 733B can drop, and the temperature of the target material 270 can drop.

Then, the first to third temperature sensors 737B to 739B may send signals corresponding to the detected temperatures to the target control apparatus 80B via the first to third temperature controllers 740B to 742B.

After this, the target control apparatus 80B may determine whether or not all of the conditions in the above Formulas (1) to (3) are met (step S25). In other words, the target control apparatus 80B may determine whether or not the temperatures T1 to T3 detected by the first to third temperature sensors 737B to 739B are essentially the same as the target temperatures T1*t* to T3*t*.

In the case where the target control apparatus 80B has determined in step S25 that at least one of the conditions of Formulas (1) to (3) has not been met, the process of step S25 may be carried out again after a predetermined amount of time has elapsed. On the other hand, in the case where it has been determined in step S25 that all of the conditions of Formulas (1) to (3) have been met, the target control apparatus 80B may determine whether or not the temperature T3 detected by the third temperature sensor 739B is less than the melting point Tm of the target material 270 (step S26). In other words, the target control apparatus 80B may determine whether or not the temperature T3 of the target material 270 held in the upper end area of the tank 711A is less than the melting point Tm.

The temperature T3 in the area of the target material 270 held in the target generator 71A that has the highest temperature being less than the melting point Tm means that the temperature of the target material 270 as a whole is less than the melting point Tm. In this case, the target material 270 as a whole can harden.

In the case where the target control apparatus 80B has determined in step S26 that the temperature T3 is not less than the melting point Tm, the process of step S23 may be carried out. The target temperatures T1*t* to T3*t* may gradually decrease by repeating the processes from step S23 to step S26. Then, the target material 270 can be cooled while maintaining the state in which the temperature is lower toward the leading end of the nozzle 712A.

On the other hand, in the case where it has been determined in step S26 that the temperature T3 is lower than the melting point Tm, the target control apparatus 80B may stop the first to third heaters 731B to 733B (step S27) and end the processing of the target material hardening subroutine.

Through the aforementioned processing, the target material 270 can be hardened in sequence from the leading end side of the nozzle 712A.

After this, the operator may open the door 20A of the chamber 2 in order to perform maintenance on the EUV collector mirror 23, for example. As a result, the solid tin oxide 276A can be formed on the surface of the adhering area 275A, in the same manner as shown in FIG. 3.

As described above, the target control apparatus 80B can precisely control the size of the adhering area 275A by actually measuring the diameter D of the adhering area 275A.

The target control apparatus 80B can exhaust the interior of the target generator 71A by applying suction using the exhaust apparatus 762B. Through this, the growth of the adhering area 275A can be quickly stopped and control for forming the adhering area 275A at a desired size can be carried out with ease.

The target material 270 in the target generator 71A can begin to harden starting with the target material 270 near the leading end of the nozzle 712A.

Here, in the case where the hardening starts from the target material 270 further from the nozzle 712A, the area that has hardened can contract and a gap can be formed between the inner wall surface and the target material 270 at the leading end of the nozzle 712A (for example, a gap similar to the gap P shown in FIG. 5B).

However, according to the second embodiment, the hardening starts from the target material 270 nearer to the leading end of the nozzle 712A, and thus a gap can be suppressed from forming between the inner wall surface and the target material 270 at the leading end of the nozzle 712A. As a result, air can be suppressed from entering into a gap, if any, formed in the nozzle 712A.

3.3 Variation

Note that the following configurations may be employed as the control method for a target supply device.

For example, a function for exhausting the interior of the target generator 71A may be provided in the configuration of the first embodiment, using the exhaust apparatus 762B. In the configuration of the first embodiment, the temperature of the target material 270 may be reduced while maintaining a state in which the temperature is lower toward the leading end of the nozzle 712A. In the first embodiment, in the case where the interval in which the process of step S5 is repeated is sufficiently short relative to the speed at which the adhering area 275A grows, it may be determined in step S5 only whether or not the measured time Kt has exceeded the minimum time Kmin.

In the second embodiment, the exhaust section 76B may be omitted. Furthermore, in the target material hardening subroutine of the second embodiment, the target material 270 may be hardened without applying a vertical temperature distribution in the target material 270.

In the first and second embodiments, an on-demand system that generates targets by using a piezoelectric element or the like to apply a compressive force to the nozzle 712A may be employed as a target supply device. In addition, a target supply device may be employed including an electrode that extracts the target material from the nozzle hole of the nozzle using static electricity and the target material may be extracted by applying a voltage to the electrode and the target material within the target generator.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more".

What is claimed is:

1. A control method for a target supply device that is provided in an EUV light generation apparatus and that includes a target generator having a nozzle and holding a target material, a pressure control unit configured to control a pressure within the target generator, and a heating unit configured to heat the target material within the target generator, the method comprising:

melting the target material by heating the target material within the target generator using the heating unit;

pushing out the target material in the target generator from a nozzle hole in the nozzle by pressurizing the interior of the target generator using the pressure control unit;

determining whether or not the size of an adhering area of the target material that forms when the target material is pushed out from the nozzle hole and adheres to a leading end of the nozzle has reached a set size that covers the entire nozzle hole;

stopping the pressurization of the interior of the target generator by the pressure control unit when the size of the adhering area has reached the set size; and hardening the target material in the target generator and the adhering area by stopping the heating of the target material by the heating unit.

2. The method according to claim 1, wherein the determining whether or not the size of the adhering area has reached the set size is carried out by determining that the set size has been reached when an amount of time that has elapsed after the pressure control unit has started pressurizing the interior of the target generator has reached a set time range.

3. The method according to claim 1, wherein the EUV light generation apparatus further includes a measurement unit configured to measure the size of the adhering area; and the determining whether or not the size of the adhering area has reached the set size is carried out by measuring the size of the adhering area using the measurement unit and determining whether or not the size of the adhering area has reached the set size based on a result of the measurement.

4. The method according to claim 1, wherein the EUV light generation apparatus further includes an exhaust unit configured to exhaust the interior of the target generator by applying suction to the interior of the target generator, and the method further comprises:

exhausting the interior of the target generator using the exhaust unit after the pressurization of the interior of the target generator by the pressure control unit has stopped and before the heating of the target material by the heating unit has stopped.

5. The method according to claim 1, wherein stopping the heating of the target material by the heating unit is carried out by reducing the temperature of the target material while maintaining a state in which the temperature of the target material that is closer to the leading end of the nozzle is lower than the temperature of the target material that is further from the leading end of the nozzle.

6. A target supply device comprising:

a target generator including a nozzle and being configured to hold a target material;

a pressure control unit that is configured to control a pressure within the target generator;

a heating unit that is configured to heat the target material within the target generator; and a target control apparatus, the target control apparatus controllably performing:

melting the target material by heating the target material within the target generator using the heating unit;

pushing out the target material in the target generator from a nozzle hole in the nozzle by pressurizing the interior of the target generator using the pressure control unit;

determining whether or not the size of an adhering area of the target material that is formed when the target material is pushed out from the nozzle hole and adheres to a leading end of the nozzle has reached a set size that covers the entire nozzle hole;

stopping the pressurization of the interior of the target generator by the pressure control unit when the size of the adhering area has reached the set size; and hardening the target material in the target generator and the adhering area by stopping the heating of the target material by the heating unit.

* * * * *